US006768885B2

(12) United States Patent
Shimizu

(10) Patent No.: US 6,768,885 B2
(45) Date of Patent: Jul. 27, 2004

(54) OPERATING SCREW WITH SPIRAL PROJECTION HAVING CYLINDRICAL SURFACE AND RETREAT SURFACE

(75) Inventor: Jun Shimizu, Hyogo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 128 days.

(21) Appl. No.: 10/029,028

(22) Filed: Dec. 28, 2001

(65) Prior Publication Data

US 2003/0059225 A1 Mar. 27, 2003

(30) Foreign Application Priority Data

Sep. 27, 2001 (JP) ..... 2001-297415

(51) Int. Cl.[7] ..... G03G 15/02
(52) U.S. Cl. ..... 399/100; 74/89.23
(58) Field of Search ..... 399/99, 100; 250/324–326; 411/411, 420, 421, 919, 416–418, 378; 74/813 R, 424.71, 424.5, 89.23; 464/79, 80

(56) References Cited

U.S. PATENT DOCUMENTS 2,232,336 A * 2/1941 Meersteiner ..... 411/421
3,280,963 A * 10/1966 Kirker
3,350,811 A * 11/1967 Bender ..... 411/411
4,161,132 A * 7/1979 Eklund et al. ..... 411/417
4,479,748 A * 10/1984 Uhlmann ..... 411/421
5,250,991 A * 10/1993 Ikeda ..... 399/100
2003/0095850 A1 * 5/2003 Nishimura et al. ..... 411/411

FOREIGN PATENT DOCUMENTS

JP 63009765 A * 1/1988 ..... F16H/25/24

* cited by examiner

*Primary Examiner*—Susan S. Y. Lee
(74) *Attorney, Agent, or Firm*—Westerman, Hattori, Daniels & Adrian, LLP

(57) ABSTRACT

The present invention is pertained to a cleaning member of a corona wire. An operating screw includes a core and an outer member enclosing the core. The core is rotatable about a rotation axis. The outer member is formed with a spiral groove. The outer member is provided with a plurality of curved surfaces and flat surfaces. The curved surfaces alternate with the curved surfaces, as viewed along the spiral groove of the outer member. The flat surfaces are retreated toward the rotation axis of the core than the curved surfaces.

12 Claims, 7 Drawing Sheets

OPERATING SCREW WITH SPIRAL PROJECTION HAVING CYLINDRICAL SURFACE AND RETREAT SURFACE

BACKGROUND OF THE INVENTION

1. Field of the Invention

The present invention relates to an operating screw for causing a counterpart member to reciprocate in a prescribed direction. The present invention also relates to a driving mechanism incorporating such an operating screw.

2. Description of the Related Art

As known in the art, an electrophotographic printer includes a photosensitive drum upon which the latent image of desired graphic matter is produced. The latent image is developed by a resinous powder (toner), and then the visible image is transferred onto recording paper.

FIG. 5 of the accompanying drawings shows some of the principal components of a conventional electrophotographic printer. Specifically, the printer includes a photosensitive drum D and corona wires W extending in parallel to the rotation axis of the drum D. In operation, the cylindrical surface of the drum D is electrically charged by the corona wires W. The charged surface is then exposed to light, to produce a latent image of the desired graphic matter. The latent image is developed by toner, and the visible image is transferred onto recording paper.

As shown in FIG. 5, the conventional printer is provided with a reciprocative cleaning unit U' for the corona wires W. The cleaning unit U' includes cloth pads M attached to supporting members 82 in a manner such that a pair of cloth pads M sandwiches one of the corona wires M. The supporting members 82 are fixed to the frame 81 of the unit U'.

The cleaning unit U' is caused to reciprocate longitudinally of the drum D by a driving mechanism 100*a* (to be described below). Upon reciprocation of the cleaning unit U', each pair of the cloth pads M is moved in sliding contact with the relevant one of the corona wires W. In this manner, it is possible to wipe off dust (including toner powder) accumulated on the wires W.

Referring to FIGS. 6A–6B, the driving mechanism 100*a* includes an operating screw 100 and a hollow cylindrical carriage 5. The screw 100 extends in parallel to the corona wires W (see also FIG. 5) and is fitted into the carriage 5. The carriage 5 is fixed to the frame 81 of the unit U'. As illustrated, the screw 100 is formed with a spiral groove 111, while the carriage 5 is formed with a spiral ridge 51 coming into engagement with the groove 111 of the screw 100. Upon rotation of the screw 100, the carriage 5 is moved along the screw 100, whereby the cleaning unit U' is moved axially of the drum D. Thus, the cloth pads M (FIG. 5) wipe off the unwanted dust on the corona wires W.

Usually, an operating screw of the above type is produced by subjecting a solid metal cylinder to mechanical processing for forming a spiral groove in it. However, the thus obtained screw often proves expensive due to the material cost and manufacturing cost.

To reduce the overall costs, the conventional operating screw 100 is fabricated by a method which does not employ a mechanical processing for making the spiral groove. Specifically, the operating screw 100 consists of a solid cylindrical core and a resin outer member (formed with the spiral groove 111 mentioned above). The grooved outer member is produced by injection molding using a die 109 consisting of four parts 191–194, as shown in FIG. 7. In the assembled state around the cylindrical core, the four parts 191–194 in combination define a cavity into which molding material (molten resin) is supplied. After the material solidifies, the molding parts 191–194 are removed. Thus, the outer member formed with the desired groove 111 is produced around the core. In accordance with such injection molding, the operating screw 100 is obtained more easily and more inexpensively than by the mechanical processing.

While the conventional screw 100 has the above-noted advantages, it still suffers from the following drawbacks.

As noted above, the outer member with the spiral groove 111 is produced by using four molding parts 191–194. In this manner, however, the resulting screw 100 tends to be formed with some casting fins or burrs B at places corresponding to the parting lines L, as shown in FIGS. 6B and 7. As readily understood, the burrs B result from the supplied molten resin flowing into the gaps formed between the neighboring mold parts 191–194 (see FIG. 7). Some of the burrs B may be formed in the spiral groove 111 (as in FIG. 6B), while others may be formed on the threads of the screw 100 (as in FIG. 7).

Disadvantageously, the burrs B may interfere with the inner surface or spiral ridge 51 of the carriage 5, thereby hindering the rotation of the screw 100. To avoid this drawback, the burrs B may be removed at a prescribed stage in the fabrication procedure with the use of e.g. a grinding device. However, such an additional grinding operation is time-consuming and lowers the production efficiency.

SUMMARY OF THE INVENTION

The present invention has been proposed under the circumstances described above. It is, therefore, an object of the present invention to provide an operating screw which is inexpensive and can be readily made. Another object of the present invention is to provide a driving mechanism incorporating such an operating screw.

According to a first aspect of the present invention, there is provided an operating screw includes: a core having a rotation axis; and an outer member enclosing the core and formed with a spiral groove. The outer member includes a first slide surface whose center of curvature resides on the rotation axis of the core. The first slide surface has a predetermined radius of curvature. The outer member also includes a first retreat surface. The distance between the retreat surface and the rotation axis is smaller than the radius of curvature of the first slide surface.

Preferably, the outer member may be made of a resin material by injection molding.

Preferably, the first retreat surface may be flat.

Preferably, the outer member may include a second slide surface whose center of curvature resides on the rotation axis of the core. The second slide surface may have a radius of curvature which is equal to the radius of curvature of the first slide surface.

Preferably, the first slide surface and the second slide surface may be spaced from each other about the rotation axis of the core, with first retreat surface intervening between the first and the second slide surfaces.

Preferably, the outer member may include a flat second retreat surface separated from the first retreat surface by the spiral groove.

Preferably, the first and the second retreat surfaces may be aligned with each other based on a reference line parallel to the rotation axis of the core.

Preferably, the spiral groove has a maximum width at a position corresponding to the reference line.

Preferably, the spiral groove may be provided with a cutout at a position corresponding to the reference line to realize the maximum width.

According to a second aspect of the present invention, there is provided a driving mechanism which includes: an operating screw provided with a spiral groove and with a spiral projection defined by the spiral groove; and a hollow cylindrical carriage provided with threads coming into engagement with the spiral groove of the screw. The spiral projection is provided with both a plurality of curved surfaces spaced from each other and a plurality of flat surfaces alternating with the curved surfaces.

Preferably, the driving mechanism of the present invention may further include both a guide rod parallel to the operating screw and a slider slidable on the guide rod. The carriage is linked to the slider.

According to a third aspect of the present invention, there is provided a printer which includes; a photosensitive drum; a charging corona wire arranged along the drum; a cleaning member held in contact with the corona wire; and a driving mechanism that moves the cleaning member longitudinally of the corona wire. The driving mechanism includes an operating screw provided with a spiral projection. The spiral projection includes both a plurality of curved surfaces spaced from each other and a plurality of flat surfaces alternating with the curved surfaces.

Other features and advantages of the present invention will become apparent from the detailed description given below with reference to the accompanying drawings.

DETAILED DESCRIPTION OF THE PREFERRED EMBODIMENT

The preferred embodiment of the present invention will be described below with reference to the accompanying drawings.

Figure 1A:
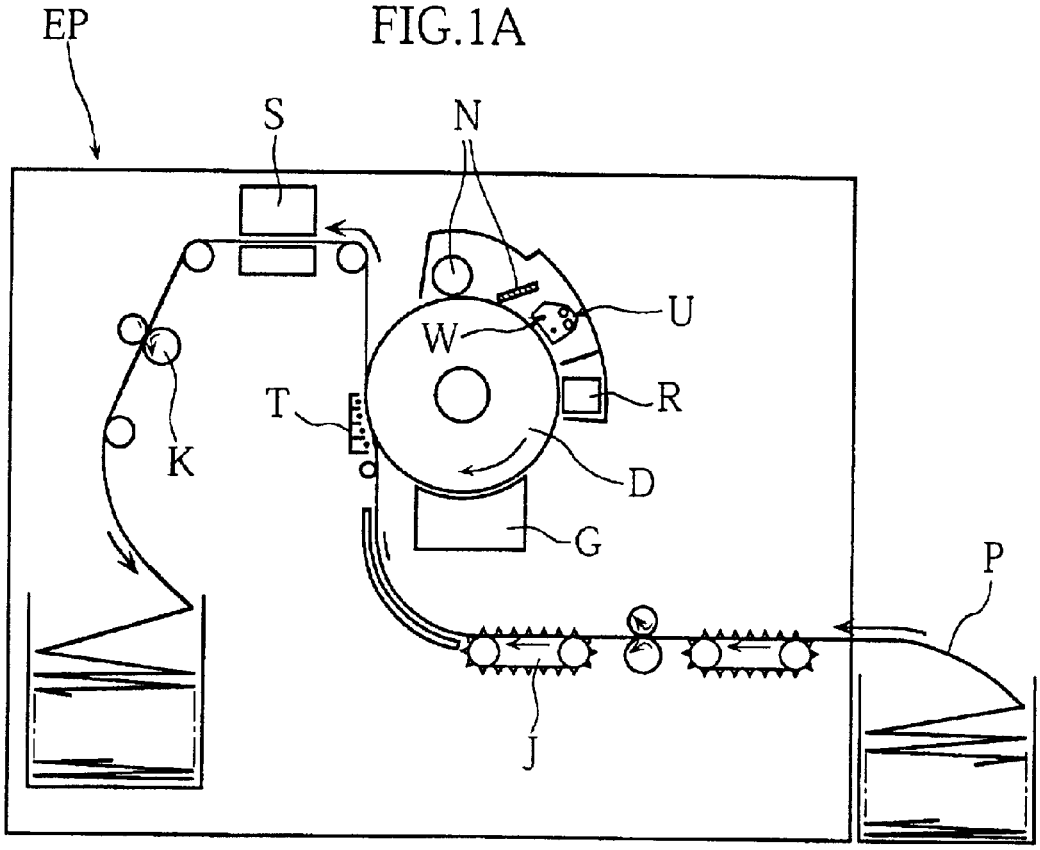
FIG. 1A is a schematic side view showing the principal components of an electrophotographic printer incorporating a cleaner driving mechanism embodying the present invention.

FIG. 1A shows the principal components of an electrophotographic printer EP incorporating a cleaner driving mechanism according to the present invention. The printer EP includes a photosensitive drum D, corona wires W, a light emitter R, a developer G, a transfer unit T, a fixing unit S and a cleaner N.

The drum D has a generally cylindrical configuration and is rotated at prescribed speed in operation. The drum D has a photosensitive surface on which desired latent images are produced. The photosensitive surface, when not exposed to light, exhibits a high electric resistance like an insulator. On the other hand, when exposed to light, the photosensitive surface exhibits a lower resistance. In the printer EP, the drum D is kept in the dark where the external light cannot reach.

The corona wires W may be made of tungsten. Each of the wires W extends near the drum surface in parallel to the rotation axis of the drum D. In operation, a high voltage (about 6000V for example) is applied to the wires W, to induce corona discharge. As a result, positive ions and negative ions are produced in the air. The positive ions are drawn to the drum D, to charge the drum surface uniformly to a positive potential.

The light emitter R may emit a laser beam toward the prescribed portions in the drum surface. The light-exposed portions of the drum surface have the resistivity lowered, whereby the accumulated charge will disappear. The remaining charged portions, which have not been exposed to light, produce the desired latent image on the drum D.

The developer G makes the latent image visible by applying toner to the drum surface. The toner-developed image is transferred onto recording paper P by the transfer unit T. The recording paper P is forwarded along the prescribed path by a paper feeding mechanism J, a roller K, etc.

The fixing unit S fuses the toner image onto the paper P for permanent fixation. To this end, the fixing unit S includes a heating device such as a heater roller or a xenon flash lamp. The cleaner N may include a cleaning blade or cleaning brush held in contact with the drum surface, so that the drum D is cleaned of all clinging toner particles.

Figure 1B:
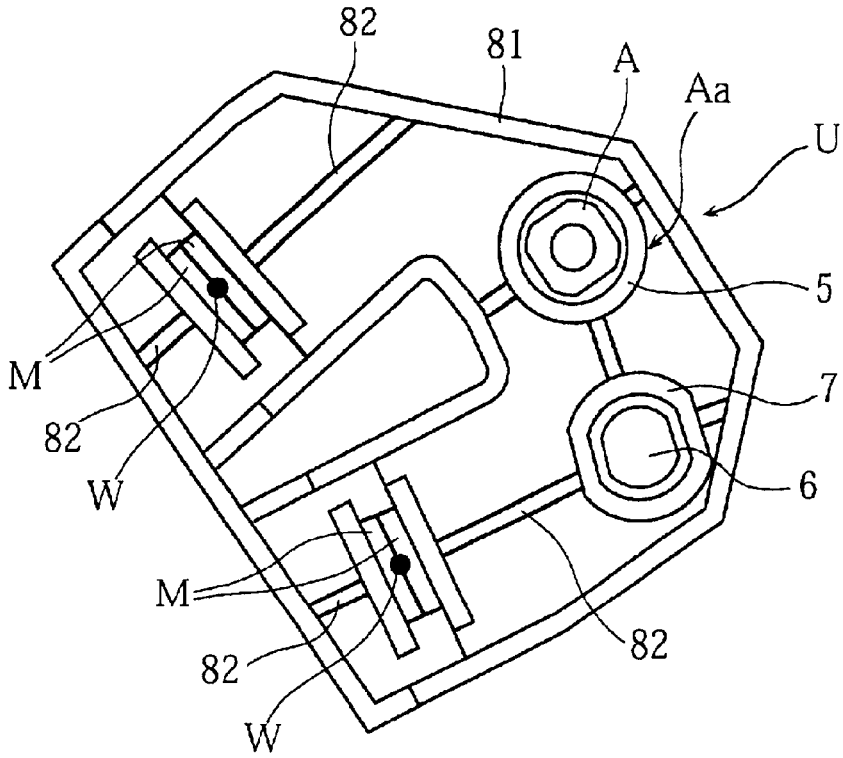
FIG. 1B is an enlarged side view showing a corona wire cleaner of the printer of FIG. 1A.
Figure 5:
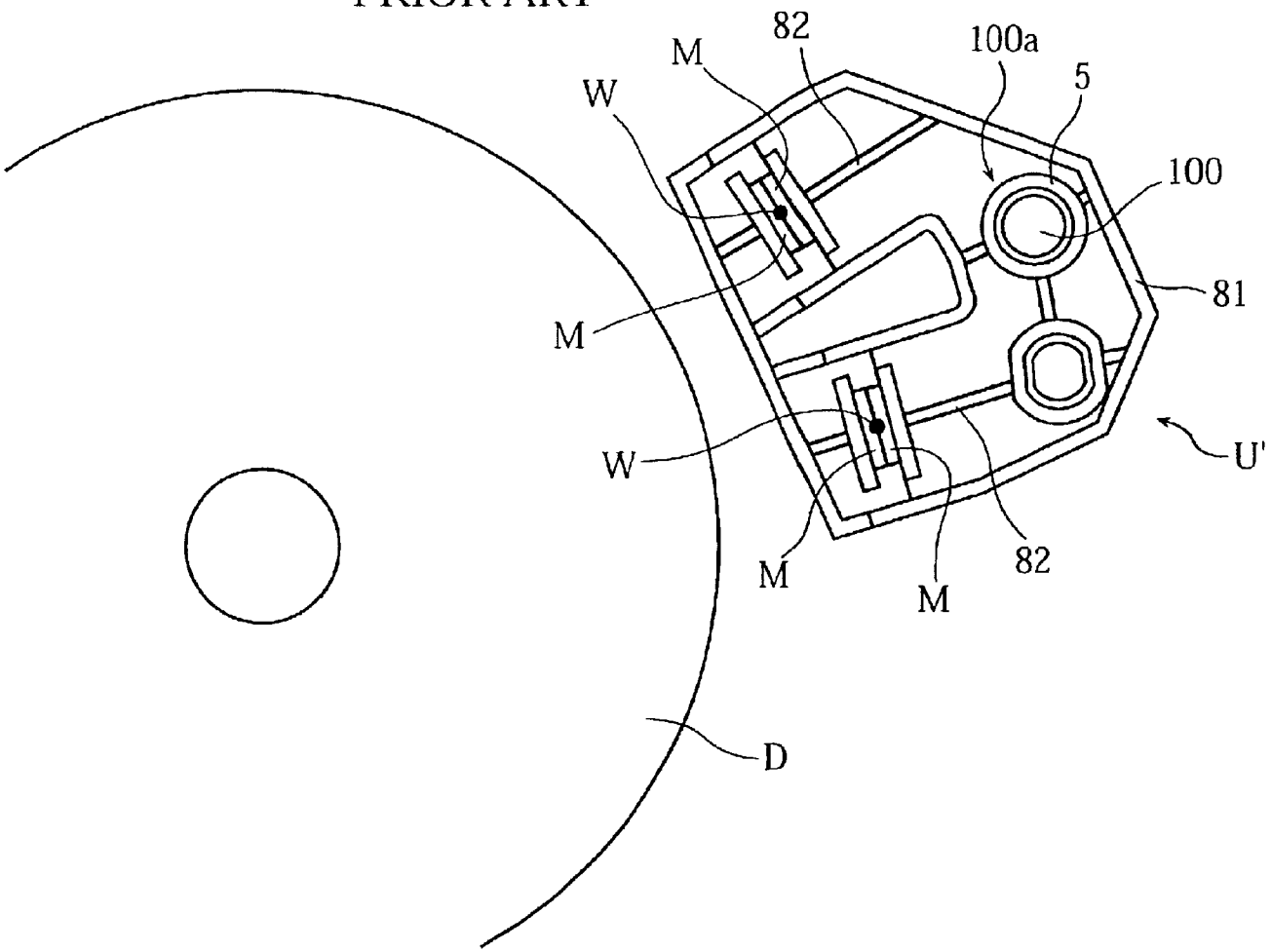
FIG.5 PRIOR ART
FIG. 5 is a side view showing principal components of a conventional electrophotographic printer.
Figure 6A:
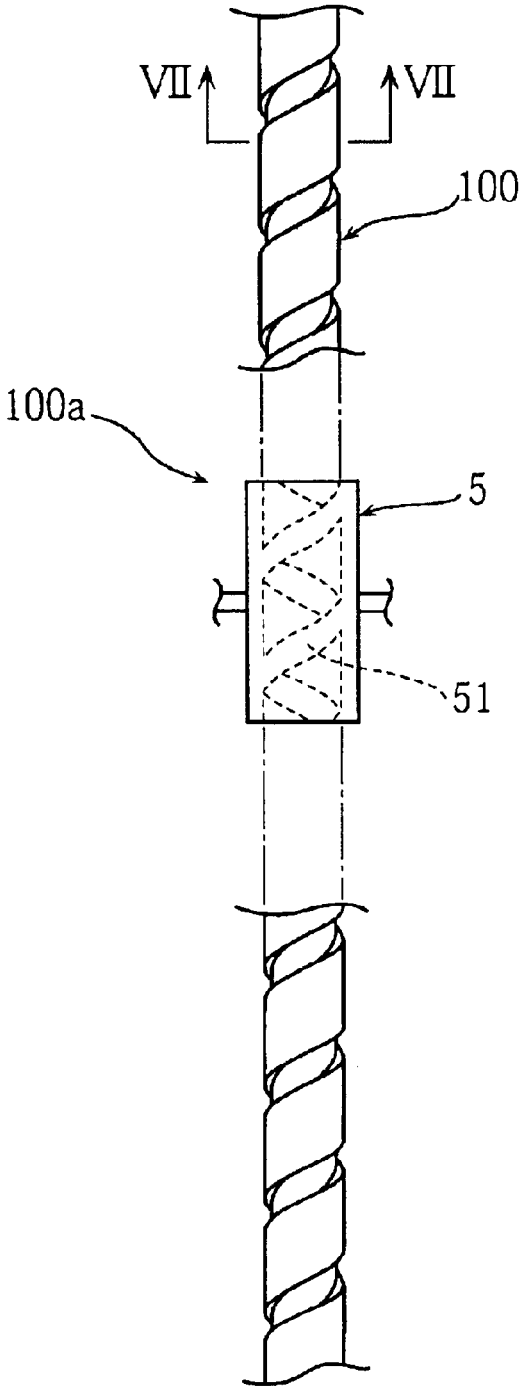
FIG.6A PRIOR ART
FIG. 6A is a plan view showing the principal components of a conventional cleaner driving mechanism.
Figure 6B:
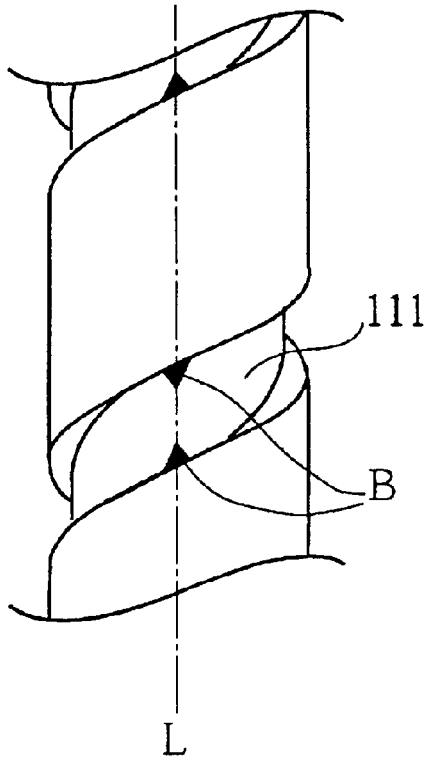
FIG.6B PRIOR ART
FIG. 6B is an enlarged plan view showing a principal portion of the operating screw of the conventional cleaner driving mechanism.
Figure 7:
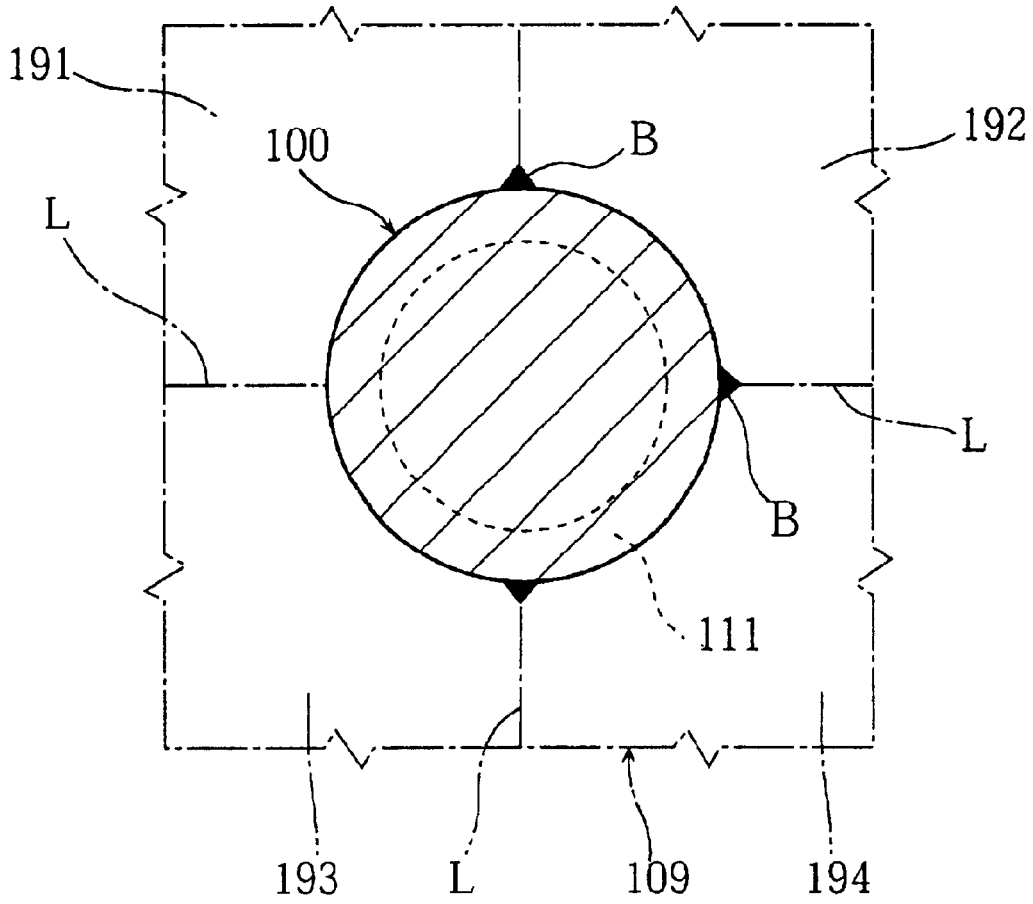
FIG.7 PRIOR ART
FIG. 7 is a sectional view taken along lines VII—VII in FIG. 6A.

Inside the printer EP, various kinds of dust (including toner particles) may float in the air. These particles may be attracted toward the corona wires W by the electrostatic force, and accumulated on the wires. To remove this dust, the printer EP is provided with a cleaning unit U for the corona wires W. The cleaning unit U includes two pairs of cloth pads M held in contact with the corona wires W. The cleaning unit U (and hence the cloth pads M) is caused to move longitudinally of the wires W in a cleaning operation. As shown in FIG. 1B, the cloth pads M are attached to pad supporters 82 which in turn are fixed to the frame 81 of the cleaning unit U. As in the conventional cleaning unit U' (FIG. 5), each pair of the cloth pads M sandwiches the relevant one of the corona wires W.

Figure 2A:
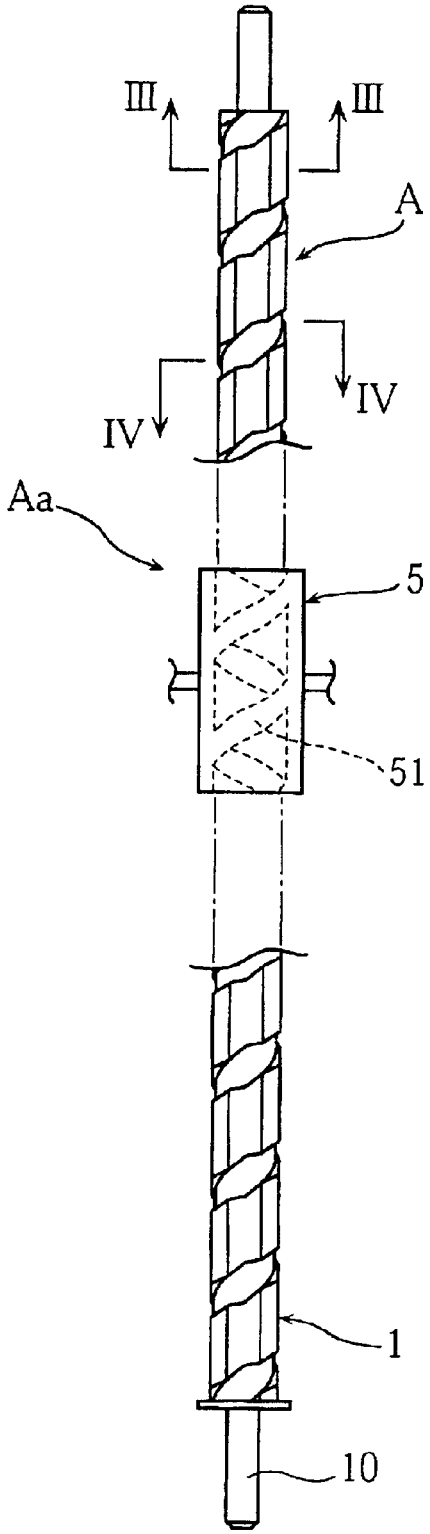
FIG. 2A is a plan view showing the principal components of the cleaner driving mechanism of the present invention.

FIG. 2A shows a driving mechanism Aa to move the cleaning unit U axially of the drum D for removing the accumulated dust on the wires W. The driving mechanism Aa includes an operating screw A and a carriage 5 supported on the screw A.

Figure 3:
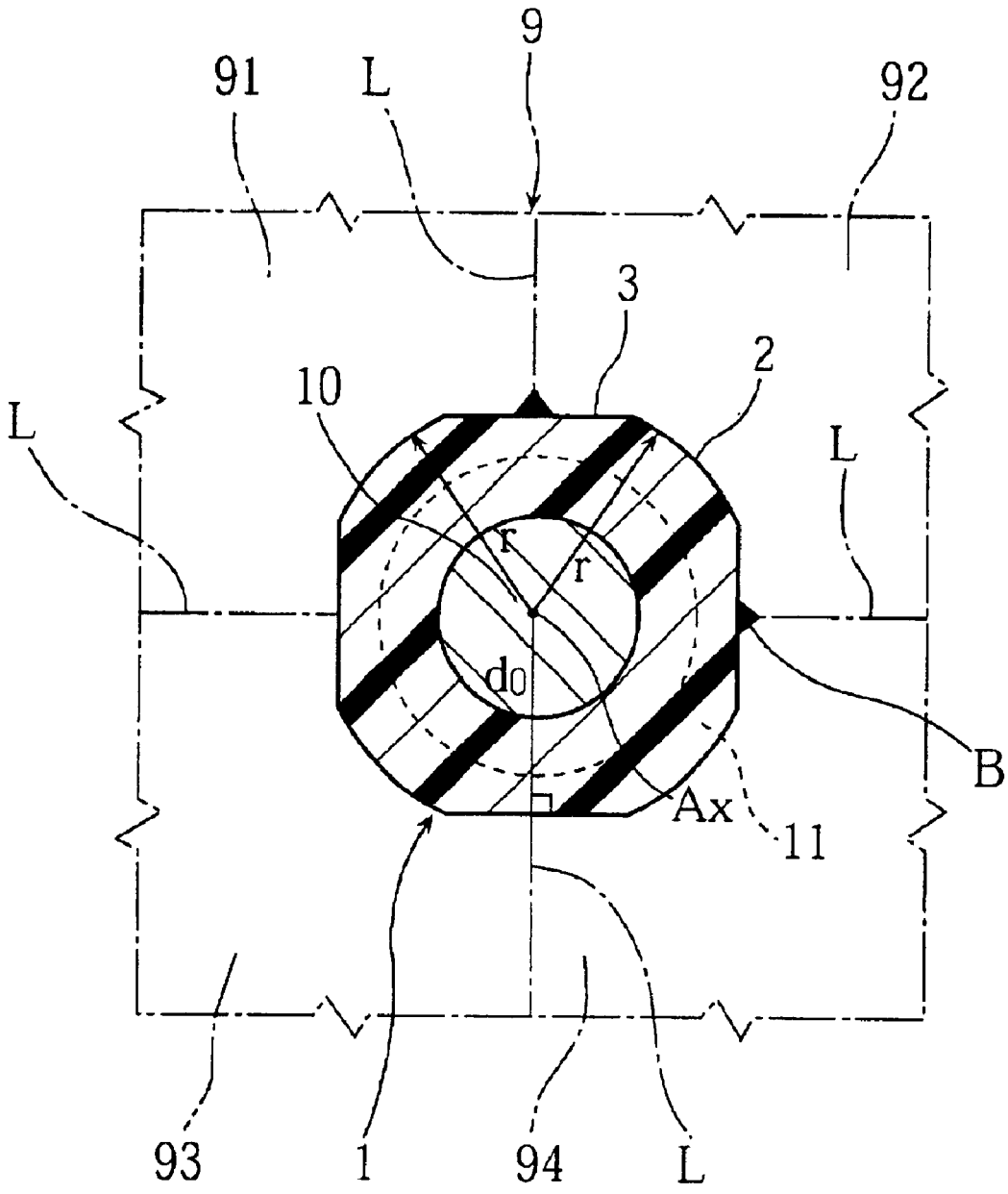
FIG. 3 is a sectional view taken along lines III—III in FIG. 2A.

The operating screw A is composed of a metal core 10 and an outer member 1 provided with a spiral groove 11. The outer member 1 is made of a resin material. As shown in FIG. 3, the outer member 1 encloses the core 10. The outer member 1 has a spiral ridge defined by the spiral groove 11. As seen from FIG. 2A, the spiral ridge of the outer member 1 has an outer surface which comes into facing relation to the inner wall surface of the hollow carriage 5. The outer surface of the spiral ridge consists of a plurality of curved portions 2 and a plurality of flat portions 3. The curved portions 2 are separated from each other along the spiral trajectory of the ridge, with the flat portions 3 intervening therebetween. As seen from FIG. 3, each of the curved surfaces 2 has a constant radius of curvature (r) and its center of curvature lies on the rotation axis Ax of the core 10. Each of the flat surfaces 3 is spaced from the axis Ax by a distance do which is smaller than the radius of curvature (r). In this sense, the flat surfaces 3 are retreated in comparison with the curved surfaces 2.

Figure 4:
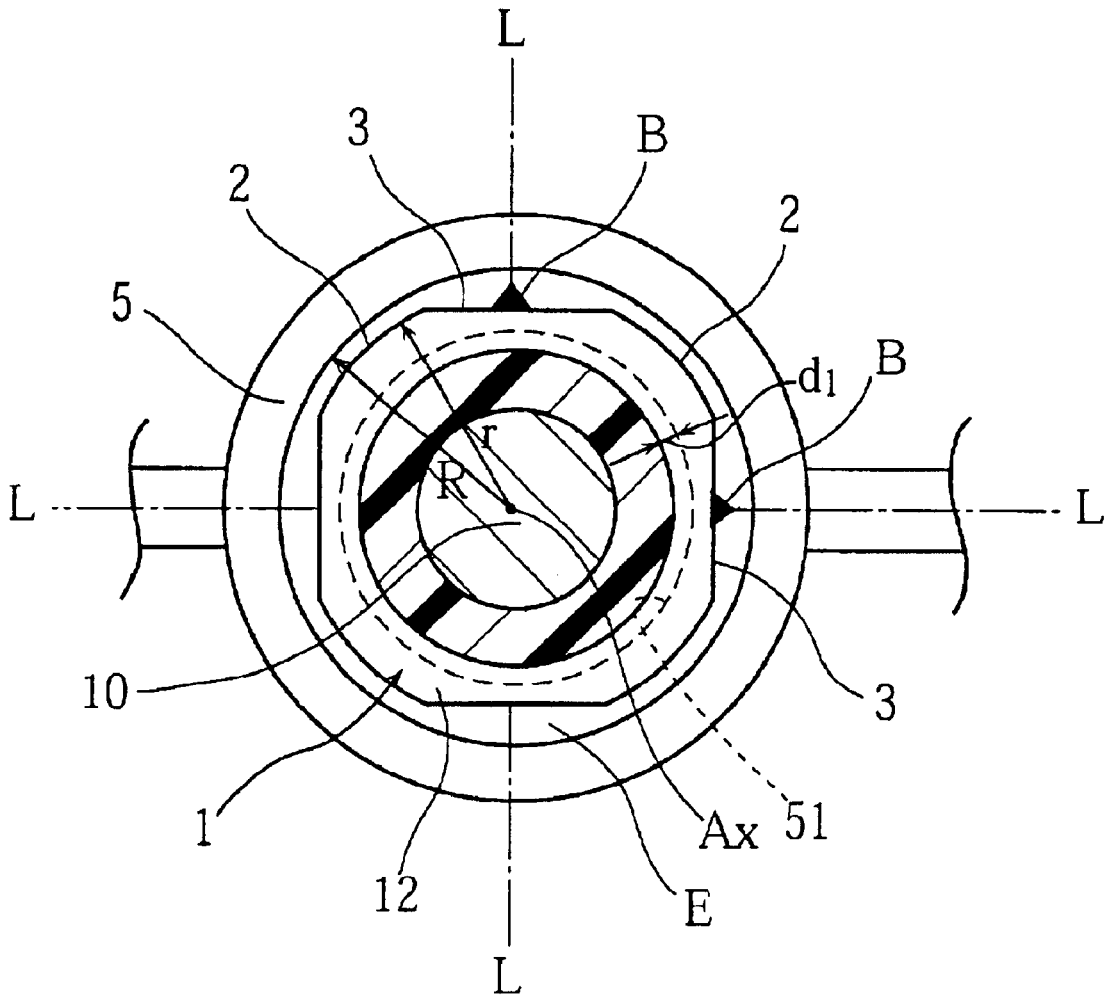
FIG. 4 is a sectional view taken along lines IV—IV in FIG. 2A.

Referring to FIG. 4, when the screw A is combined with the carriage 5, a wider space E is permitted between the flat surfaces 3 and the carriage 5 than between the curves surfaces 2 and the carriage 5.

Figure 2B:
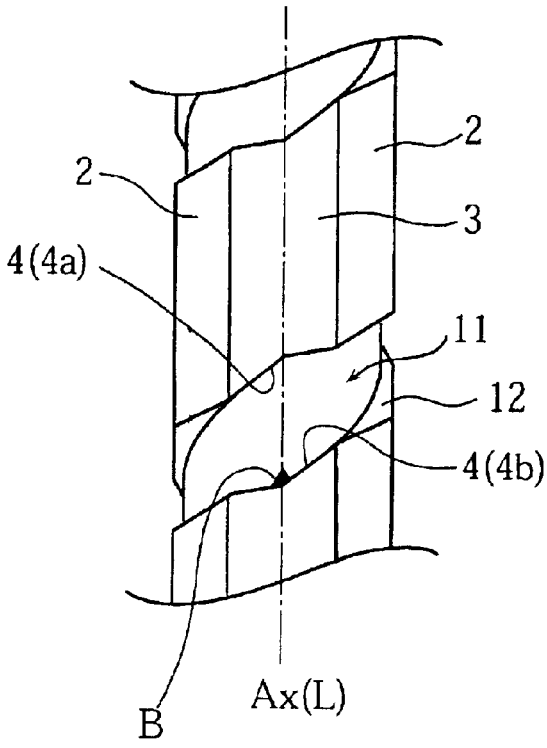
FIG. 2B is an enlarged plan view showing a principal portion of the operating screw of the cleaner driving mechanism.

Referring back to FIG. 2B, the spiral groove 11 is provided with cutouts 4 in its side wall surfaces 12. As illustrated, the cutouts 4 correspond in location to the flat surfaces 3. In the illustrated embodiment, one cutout 4*a* is spaced apart from the counterpart cutout 4*b* in a direction parallel to the rotation axis Ax of the core 10. As a result, the width of the groove 11, as measured axially of the core 10, becomes greatest at the paired cutouts 4 (4*a*, 4*b*) than at other locations.

The outer member 1 is made by injection molding using a resin material. Specifically, as shown in FIG. 3, a mold or die 9 consisting of four parts 91–94 is used. The four mold parts 91–94, when assembled around the core 10, define a cavity configured to form the outer member 1. In FIG. 3, the joint or parting line between any two of the neighboring mold parts is designated by reference sign L. The parting lines L correspond in location to the flat surfaces 3, but do not come on the curves surfaces 4.

After the four mold parts 91–94 are properly combined around the core 10, molten resin material is poured into the cavity of the die 9. Then, the die 9 is removed after the supplied resin solidifies. Since the die 9 is composed of four mold parts, it is easy to detach the die 9 from the hardened resin material.

According to the present invention, the outer member 1 may not be directly formed on the core 10 as described above. Alternatively, the outer member 1 may be prepared separately from the core 10, and afterward the core 10 is inserted into a receiving bore formed in the outer member 1.

Referring to FIG. 4, the inner wall surface of the carriage 5 has a radius of curvature (R) which is greater than the radius of curvature (r) of the curved surfaces 2 of the outer member 1. The carriage 5 is provided with a spiral ridge 51 (see also FIG. 2A) projecting inward from the inner wall surface of the carriage 5. In operation, the ridge 51 comes into engagement with the groove 11 of the screw A. The ridge 51 has a uniform configuration (i.e., invariant cross section, constant width or height, etc.) along its entire length. The ridge 51 is short enough to avoid contact with the bottom surface of the groove 11 of the outer member 1. In FIG. 4, the clearance between the ridge 51 and the bottom surface of the groove 11 is designated by reference sign $d_1$.

The carriage 5 is fixed to the frame 81 of the cleaning unit U (see FIG. 1B). Upon rotation of the operating screw A, the carriage 5 (and hence the unit U as a whole) is moved along the screw A.

For ensuring stable reciprocation of the cleaning unit U, the driving mechanism Aa includes a guide rod 6 having a uniform cross section, and a slider 7 formed with an opening into which the guide rod 6 is slidably fitted. The slider 7 is connected to the carriage 5 and to the frame 81. The guide rod 6 is generally equal in length to the screw A and parallel to the screw A. Upon rotation of the screw A, the cleaning unit U is moved along the drum D as properly guided by the guide rod 6.

With the above arrangement, the cleaning unit U is moved along the drum D by the driving mechanism Aa, whereby the cloth pads M wipe off the dust on the corona wires W.

As noted above, the grooved outer member 1 of the screw A is made of resin by injection molding. Thus, the operating screw A of the present invention is produced more easily and at a lower cost than the conventional operating screw.

Further, the outer member 1 is provided with retreated surfaces 3 corresponding in position to the parting lines L defined by the four mold parts 91–94. Thus, if burrs B are formed on the flat surfaces 3 due to the penetration of the molding material into the gaps at the parting lines L, the burrs B will not come into contact with the inner wall surface of the carriage 5 (see FIG. 4). In addition, since the groove 11 of the outer member 1 is provided with cutouts 4 (see FIG. 2B) corresponding in position to the parting lines L. Thus, if a burr B is formed on the side wall surface 12 of the groove 11, the burr is contained in the cutout 4, so that it does not interfere with the inward ridge 51 of the carriage 5.

It should be noted here that a burr can be formed on the bottom surface of the groove 11, between the two side wall surfaces 12 facing to each other. However, such a burr is not detrimental to smooth movement of the carriage 5 on the screw A when the clearance $d_1$ (FIG. 4) between the ridge 51 and the bottom surface is made sufficiently large.

According to the present invention, there is no need to remove burrs B formed on the resin outer member 1. Thus, the production efficiency of the screw A is advantageously improved than that of the conventional screw 100.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

What is claimed is:

1. An operating screw comprising:

a core having a rotation axis; and an outer member enclosing the core and formed with a spiral groove;

wherein the outer member includes a first slide surface which has a center of curvature residing on the rotation axis and has a predetermined radius of curvature, the outer member also including a first retreat surface which is spaced apart from the rotation axis by a distance smaller than the radius of curvature of the first slide surface, wherein the outer member is formed of resin with use of a plurality of mold parts associating with each other, at least two of the mold parts having a joint therebetween, the joint locating on the retreat surface.

2. The operating screw according to claim 1, wherein the first retreat surface is flat.

3. The operating screw according to claim 1, wherein the outer member includes a second slide surface which has a center of curvature residing on the rotation axis and has a radius of curvature equal to the radius of curvature of the first slide surface.

4. The operating screw according to claim 3, wherein the first slide surface and the second slide surface are spaced from each other about the rotation axis, the first retreat surface being disposed between the first slide surface and the second slide surface.

5. The operating screw according to claim 1, wherein the outer member includes a second retreat surface, the second retreat surface being flat and separated from the first retreat surface by the spiral groove.

6. The operating screw according to claim 5, wherein the first and the second retreat surfaces are aligned with each other based on a reference line parallel to the rotation axis.

7. The operating screw according to claim 6, wherein the spiral groove has a maximum width at a position corresponding to the reference line.

8. The operating screw according to claim 7, wherein the spiral groove comprising a cutout at a position corresponding to the reference line to realize the maximum width.

9. The operating screw according to claim 1, wherein the outer member comprises a single spiral projection defined by the spiral groove, the spiral projection including the first slide surface and the first retreat surface, and wherein the first slide surface and the first retreat surface alternate along the spiral projection.

10. A driving mechanism comprising:

an operating screw provided with a spiral groove and a spiral projection defined by the spiral groove; and a hollow cylindrical carriage provided with threads coming into engagement with the spiral groove;

wherein the spiral projection comprises a spiral top surface of the projection, the top surface further comprising both a plurality of curved surfaces spaced from each other and a plurality of flat surfaces alternating with the curved surfaces along the top surface.

11. The driving mechanism according to claim 10, further comprising a guide rod parallel to the operating screw and a slider slidable on the guide rod, wherein the carriage is linked to the slider.

12. A printer comprising;

a photosensitive drum;

a charging corona wire arranged along the drum;

a cleaning member held in contact with the corona wire; and a driving mechanism that moves the cleaning member longitudinally of the corona wire;

wherein the driving mechanism includes an operating screw provided with a spiral projection, the spiral projection including both a plurality of curved surfaces spaced from each other and a plurality of flat surfaces alternating with the curved surfaces.

* * * * *